US008431810B2

(12) United States Patent
Takahashi et al.

(10) Patent No.: US 8,431,810 B2
(45) Date of Patent: Apr. 30, 2013

(54) TEMPO DETECTION DEVICE, TEMPO DETECTION METHOD AND PROGRAM

(75) Inventors: Shusuke Takahashi, Chiba (JP); Akira Inoue, Tokyo (JP)

(73) Assignee: Sony Corporation, Tokyo (JP)

( * ) Notice: Subject to any disclaimer, the term of this patent is extended or adjusted under 35 U.S.C. 154(b) by 27 days.

(21) Appl. No.: 13/190,731

(22) Filed: Jul. 26, 2011

(65) Prior Publication Data

US 2012/0024130 A1 Feb. 2, 2012

(30) Foreign Application Priority Data

Aug. 2, 2010 (JP) ..... P2010-173253

(51) Int. Cl.
*G10H 1/40* (2006.01)

(52) U.S. Cl.
USPC ..... 84/612; 84/611; 84/616; 84/651; 84/652; 84/654

(58) Field of Classification Search ..... None
See application file for complete search history.

(56) References Cited

U.S. PATENT DOCUMENTS

| | | | | |
|---|---|---|---|---|
| 6,201,176 | B1 * | 3/2001 | Yourlo | 84/609 |
| 2004/0254660 | A1 * | 12/2004 | Seefeldt | 700/94 |
| 2007/0022867 | A1 * | 2/2007 | Yamashita | 84/612 |
| 2008/0188967 | A1 * | 8/2008 | Taub et al. | 700/94 |
| 2008/0190271 | A1 * | 8/2008 | Taub et al. | 84/645 |
| 2008/0190272 | A1 * | 8/2008 | Taub et al. | 84/645 |
| 2009/0056526 | A1 * | 3/2009 | Yamashita et al. | 84/611 |
| 2010/0154619 | A1 * | 6/2010 | Taub et al. | 84/616 |
| 2010/0204813 | A1 * | 8/2010 | Taub et al. | 700/94 |
| 2010/0212478 | A1 * | 8/2010 | Taub et al. | 84/645 |
| 2010/0251877 | A1 * | 10/2010 | Jochelson et al. | 84/609 |
| 2012/0024130 | A1 * | 2/2012 | Takahashi et al. | 84/612 |
| 2012/0155658 | A1 * | 6/2012 | Tsunoo et al. | 381/57 |
| 2012/0215546 | A1 * | 8/2012 | Biswas et al. | 704/500 |

FOREIGN PATENT DOCUMENTS

| | | |
|---|---|---|
| JP | 2002-221240 | 8/2002 |
| JP | 2007-33851 | 2/2007 |

* cited by examiner

*Primary Examiner* — Marlo Fletcher

(74) *Attorney, Agent, or Firm* — Finnegan, Henderson, Farabow, Garrett & Dunner, LLP

(57) ABSTRACT

A tempo detection device includes: a basic feature amount extracting section which extracts a plurality of types of basic feature amounts from an input audio signal; a weighting and adding section which weights and adds the basic feature amounts of the plurality of types extracted in the basic feature amount extracting section to obtain an addition signal; and a tempo detecting section which detects BPM indicating the tempo on the basis of a periodic component included in the addition signal obtained in the weighting and adding section.

7 Claims, 9 Drawing Sheets

TEMPO DETECTION DEVICE, TEMPO DETECTION METHOD AND PROGRAM

BACKGROUND

The present disclosure relates to a tempo detection device, a tempo detection method, and a program, and in particular, to a tempo detection device, a tempo detection method, and a program in which an audio signal of music is processed to detect the tempo of the music.

The music tempo represents the proceeding speed of music, and BPM (Beats Per Minute: the number of quarter notes per minute) is mainly used as an index representing the tempo of the music. In order to detect the BPM of music, there has been disclosed the following techniques in the related art.

Japanese Unexamined Patent Application Publication No. 2002-221240 discloses a technique which calculates autocorrelation of music waveform signals, analyzes a beat structure of music on the basis of the calculation result, and extracts the tempo of the music on the basis of the analysis result. Further, Japanese Unexamined Patent Application Publication No. 2007-033851 discloses a technique which divides an input audio signal into a plurality of frequency bands, detects peaks of the input audio signal for each frequency band, calculates a time interval in the peak locations, and detects the tempo on the basis of the time interval with a frequent peak generation.

SUMMARY

The technique disclosed in Japanese Unexamined Patent Application Publication No. 2002-221240 has a problem in that the calculation amount is excessive in consideration of a brief analysis on an embedded processor for a portable device. Further, the technique disclosed in Japanese Unexamined Patent Application Publication No. 2007-033851 is designed for a low calculation amount, but there are problems in that the time interval of the peaks does not correspond to BPM as it is in many cases and the detection efficiency is not sufficiently high. In particular, there are many cases where the BPM is mistakenly set to double or one half. For example, in a case where the correct BPM is 60, BPM=120 may be detected, or in a case where the correct BPM is 100, BPM=50 may be detected.

Accordingly, it is desirable to provide a technique which is capable of detecting the tempo of music in a low calculation amount with high efficiency.

According to an embodiment of the present disclosure, there is provided a tempo detection device including: a basic feature amount extracting section which extracts a plurality of types of basic feature amounts from an input audio signal; a weighting and adding section which weights and adds the basic feature amounts of the plurality of types extracted in the basic feature amount extracting section to obtain an addition signal; and a tempo detecting section which detects BPM indicating the tempo on the basis of a periodic component included in the addition signal obtained in the weighting and adding section.

According to the embodiment, the basic feature amount extracting section extracts the basic feature amounts of the plurality of types from the input audio signal. For example, the basic feature amount extracting section divides the input audio signal into frames including a predetermined number of pieces of sample data and extracts the basic feature amounts of the plurality of types for each frame. For example, in a case where a sampling frequency of the input audio signal is 22.050 kHz, the input audio signal is divided into frames including 1024 pieces of sample data.

For example, the basic feature amount extracting section includes a short-time Fourier transform section and a basic feature amount calculating section. The short-time Fourier transform section performs a short-time Fourier transform for each frame of the input audio signal. The basic feature amount calculating section calculates the basic feature amounts of the plurality of types, that is, "Spectrum Flux", "Spectrum Centroid", and "Roll-Off", on the basis of a frequency spectrum for each frame output from the short-time Fourier transform section.

The weighting and adding section weights and adds the basic feature amounts of the plurality of types extracted in the basic feature amount extracting section to obtain the addition signal. Here, for example, weight coefficients are manually obtained, but may be automatically determined by learning. Further, the tempo detecting section detects the periodic component included in the addition signal obtained in the weighting and adding section, and detects the BPM indicating the tempo on the basis of the periodic component.

For example, the tempo detecting section includes a fast Fourier transform section, a score calculating section, and a BPM determining section. The fast Fourier transform section performs a fast Fourier transform for the addition signal for each frame, for a periodicity analysis.

The score calculating section divides respective samples in a frequency axis output from the fast Fourier transform section into a predetermined number of continuous frequency regions, which include a frequency region in which it is assumed that a correct BPM is present, and in which a frequency region adjacent to a low pass side becomes one half and a frequency region adjacent to a high pass side becomes double. Further, the score calculating section calculates a score corresponding to the level of each sample data for each frequency region and for each sample.

The BPM determining section includes a score adding section and a maximum value searching section. The score adding section matches the numbers of samples of the respective frequency regions, and adds the sample scores of the respective frequency regions for the corresponding samples on the basis of the score for each frequency region and for each sample calculated in the score calculating section. The maximum value searching section calculates a frequency corresponding to the samples having a maximum value among score addition values for each of the samples obtained by the addition in the score adding section, from the frequency region in which it is assumed that the correct BPM is present, and determines the BPM corresponding to the frequency as the BPM indicating the tempo.

In this way, according to the embodiment, the basic feature amounts of the plurality of types are extracted from the input audio signal; the basic feature amounts of the plurality of types are weighted and added to obtain the addition signal; and the BPM indicating the tempo is detected on the basis of the periodic component included in the addition signal. Accordingly, it is possible to detect the tempo of music in a low calculation amount with high efficiency.

According to the embodiment, for example, the tempo detection device further includes a tempo modifying section which modifies the BPM detected in the tempo detecting section on the basis of the basic feature amounts of the plurality of types extracted in the basic feature amount extracting section. The tempo modifying section may obtain a first sense of speed for determining whether the correct BPM is present on a high pass side with reference to the frequency region in which it is assumed that the correct BPM is present and obtain a second sense of speed for determining whether the correct BPM is present on a low pass side with reference to the frequency region in which it is assumed that the correct BPM is present, on the basis of the basic feature amounts of the plurality of types. Then, the tempo modifying section may double the BPM detected in the tempo detecting section, when it is determined that the correct BPM is present on the high pass side with reference to the frequency region in which it is assumed that the correct BPM is present through the first sense of speed, to output the BPM, may reduce the BPM detected in the tempo detecting section to one half, when it is determined that the correct BPM is present on the low pass side with reference to the frequency region in which it is assumed that the correct BPM is present through the second sense of speed, to output the BPM, and may output the BPM detected in the tempo detecting section as it is when it is determined that the correct BPM is not present on the high pass side with reference to the frequency region in which it is assumed that the correct BPM is present through the first sense of speed, and when it is determined that the correct BPM is not present on the low pass side with reference to the frequency region in which it is assumed that the correct BPM is present through the second sense of speed.

In this case, a modifying process of the BPM is performed by obtaining the first and second senses of speed for determining whether the correct BPM is present on the high pass side and the low pass side with reference to the frequency region in which it is assumed that the correct BPM is present, on the basis of the basic feature amounts of the plurality of types, and it is possible to appropriately modify the BPM in a case where the correct BPM is present on the high or low pass side with reference to the frequency region in which it is assumed that the correct BPM is present. Further, in this case, it is possible to use the basic feature amounts of the plurality of types extracted in the basic feature amount extracting section without performing extra basic feature amount calculation.

Further, according to the embodiment, for example, the basic feature amount extracting section divides the input audio signal into the frames including the predetermined number of pieces of sample data and extracts the basic feature amounts of the plurality of types for each frame, and the tempo modifying section is configured to obtain the first sense of speed and the second sense of speed for each block including a predetermined number of frames. Here, the tempo modifying section may obtain the first sense of speed by weighting averages and standard deviations of the basic feature amounts of the plurality of types in the predetermined number of frames by a first coefficient group obtained by learning in advance and by adding the weighted averages and standard deviations, and may obtain the second sense of speed by weighting the averages and the standard deviations of the basic feature amounts of the plurality of types in the predetermined number of frames by a second coefficient group obtained by learning in advance and by adding the weighted averages and standard deviations. For example, the basic feature amounts of the plurality of types include "ZCR", "Spectrum Flux", "Spectrum Centroid", and "Roll-Off".

According to the present disclosure, the basic feature amounts of the plurality of types are extracted from the input audio signal, the basic feature amounts of the plurality of types are weighted and added to obtain the addition signal, and the BPM indicating the tempo is detected on the basis of the periodic component included in the addition signal. Accordingly, it is possible to detect the tempo of music in a low calculation amount with high efficiency.

DETAILED DESCRIPTION OF EMBODIMENTS

Hereinafter, embodiments according to the present disclosure will be described in the following order;

1. First embodiment
2. Second embodiment
3. Modifications

1. First Embodiment

[Configuration Example of Music Tempo Detection Device]

Figure 1:
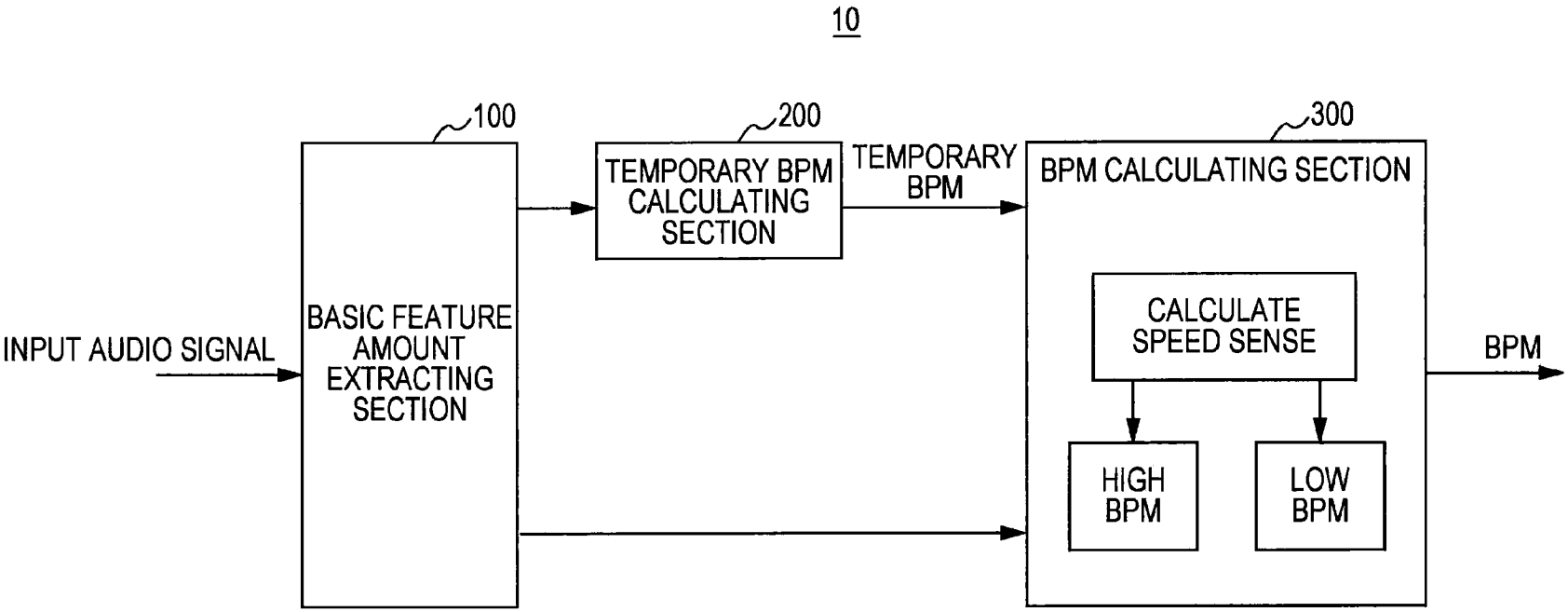
FIG. 1 is a block diagram illustrating an example of a configuration of a music tempo detection device according to a first embodiment of the present disclosure.

FIG. 1 illustrates an example of a configuration of a music tempo detection device 10 according to a first embodiment. The music tempo detection device 10 detects the BPM (Beats Per Minute) representing the tempo of music per a predetermined time, for example, every 30 seconds, for an audio signal. The music tempo detection device 10 detects the BPM representing the music tempo, using values of various basic feature amounts obtained from data on an audio signal in the time axis and the frequency axis and periodicity thereof. The music tempo detection device 10 includes a basic feature amount extracting section 100, a temporary BPM calculating section 200, and a BPM calculating section 300.

The basic feature amount extracting section 100 calculates a plurality of types of basic feature amounts, for each frame, from an input audio signal (PCM signal). In this embodiment, the basic feature amounts of the plurality of types correspond to "ZCR (Zero Crossing Rate)", "Spectrum Flux", "Spectrum Centroid", and "Roll-Off". These basic feature amounts are disclosed in "George Tzanetakis and Perry Cook, Musical genre classification of audio signals, IEEE Transactions of Speech and Audio Processing, 10(5):293-302, July 2002".

The basic feature amounts of "ZCR", "Spectrum Flux", "Spectrum Centroid", and "Roll-Off" generally have the following implications. The "ZCR" is the number of times that a time waveform of an input audio signal intersects the transverse axis during unit time. The "Spectrum Flux" is power variation in a frequency spectrum for every frame. The "Spectrum Centroid" is the center of a frequency spectrum for every frame. The "Roll-Off" is a frequency reaching 85% of the total sum of the frequency spectrum for every frame.

The temporary BPM calculating section 200 considers the basic feature amounts of the plurality of types for every frame extracted by the basic feature amount extracting section 100 as time series data, and detects a periodic component (repetitive component) included in a weighted addition signal of the basic feature amount of the plurality of types, to thereby calculate the temporary BPM. The temporary BPM calculating section 200 uses the basic feature amounts of "Spectrum Flux", "Spectrum Centroid", and "Roll-Off". The temporary BPM calculating section 200 forms a weighting and adding section and a tempo detecting section.

Here, the temporary BPM takes BPM0 to BPM0×2, and approximately 75 is used as BPM0. Even in a case where a correct BPM is not present between BPM0 to BPM0×2, the temporary BPM calculating section 200 outputs a value between BPM0 to BPM0×2 as the temporary BPM. For example, in a case where the correct BPM is 180, the temporary BPM calculating section 200 outputs 90 as the temporary BPM. Further, for example, in a case where the correct BPM is 50, the temporary BPM calculating section 200 outputs 100 as the temporary BPM.

The BPM calculating section 300 calculates a sense of speed on the basis of the basic feature amounts extracted by the basic feature amount extracting section 100, and determines whether the correct BPM is a BPM (high BPM) exceeding 150 or a BPM (low BPM) lower than BPM0 (about 75). The BPM calculating section 300 uses the basic feature amounts of "ZCR (Zero Crossing Rate)", "Spectrum Flux", "Spectrum Centroid", and "Roll-Off", when calculating the sense of speed.

The BPM calculating section 300 doubles the temporary BPM calculated by the temporary BPM calculating section 200 to obtain BPM, when it is determined that the correct BPM is the high BPM. Further, the BPM calculating section 300 reduces the temporary BPM calculated by the temporary BPM calculating section 200 to one half to obtain the BPM, when it is determined that the correct BPM is the low BPM. Further, when it is determined that the correct BPM is neither the high BPM nor the low BPM, the BPM calculating section 300 uses the temporary BPM calculated by the temporary BPM calculating section 200 as BPM as it is. The BPM calculating section 300 forms a tempo modifying section.

An operation of the music tempo detection device 10 shown in FIG. 1 will be described. The input audio signal (PCM signal) is supplied to the basic feature amount extracting section 100. In the basic feature amount extracting section 100, the basic feature amounts of "ZCR", "Spectrum Flux", "Spectrum Centroid", and "Roll-Off" are extracted from the input audio signal, for each frame.

The basic feature amounts of the "ZCR", "Spectrum Flux", "Spectrum Centroid", and "Roll-Off" for each frame which are extracted by the basic feature amount extracting section 100 are supplied to the temporary BPM calculating section 200. In the temporary BPM calculating section 200, each basic feature amount extracted for each frame by the basic feature amount extracting section 100 is considered as time series data, and is weighted and added. Further, in the temporary BPM calculating section 200, the period component (repetitive component) included in the weighed addition signal is extracted, and the temporary BPM is calculated. The temporary BPM is a value between BPM0 to BPM0×2 (BPM0 is about 75).

The temporary BPM calculated by the temporary BPM calculating section 200 is supplied to the BPM calculating section 300. The temporary BPM is a value between BPM0 to BPM0×2 (BPM0 is about 75). That is, in the temporary BPM calculating section 200, even in a case where the correct BPM is not present between BPM0 to BPM0×2, the value between BPM0 to BPM0×2 is output as the temporary BPM. Further, the basic feature amounts of "ZCR", "Spectrum Flux", "Spectrum Centroid", and "Roll-Off" extracted by the basic feature amount extracting section 100 for each frame are supplied to the BPM calculating section 300.

In the temporary BPM calculating section 300, the sense of speed is calculated on the basis of the basic feature amounts of "ZCR", "Spectrum Flux", "Spectrum Centroid", and "Roll-Off" extracted by the basic feature amount extracting section 100. In the BPM calculating section 300, it is determined whether the correct BPM is the BPM (high BPM) exceeding BPM0×2 (BPM0 is about 75), or the BPM (low BPM) lower than BPM0 on the basis of the calculated speed sense.

Further, in the BPM calculating section 300, when it is determined that the correct BPM is the high BPM, the temporary BPM calculated by the temporary BPM calculating section 200 is doubled to be output as the BPM. Further, in the BPM calculating section 300, when it is determined that the correct BPM is the low BPM, the temporary BPM calculated by the temporary BPM calculating section 200 is reduced to one half to be output as the BPM. Further, in the BPM calculating section 300, when it is determined that the BPM is neither the high BPM nor the low BPM, the temporary BPM calculated by the temporary BPM calculating section 200 is output as the BPM as it is.

[Description of Basic Feature Amount Calculating Section]

Details of the basic feature amount calculating section 100 will be described. As described above, the basic feature amount calculating section 100 calculates the basic feature amounts of the plurality of types used in the periodic component extraction process in the temporary BPM calculating section 200 and the speed sense calculation process in the BPM calculating section 300. The basic feature amounts of the plurality of types correspond to "ZCR", "Spectrum Flux", "Spectrum Centroid", and "Roll-Off", as described above.

The basic feature extracting section 100 extracts "ZCR", "Spectrum Flux", "Spectrum Centroid", and "Roll-Off", from the input audio signal. The input audio signal is channel transformed and sampling frequency transformed in advance so that the input audio signal is monaural and has a sampling frequency of 22.050 kHz. The basic feature amount extracting section 100 divides the input audio signal into 1024 sample (about 46 msec) frames, calculates the basic feature amounts for each frame, and then stores the result in a buffer.

Figure 2:
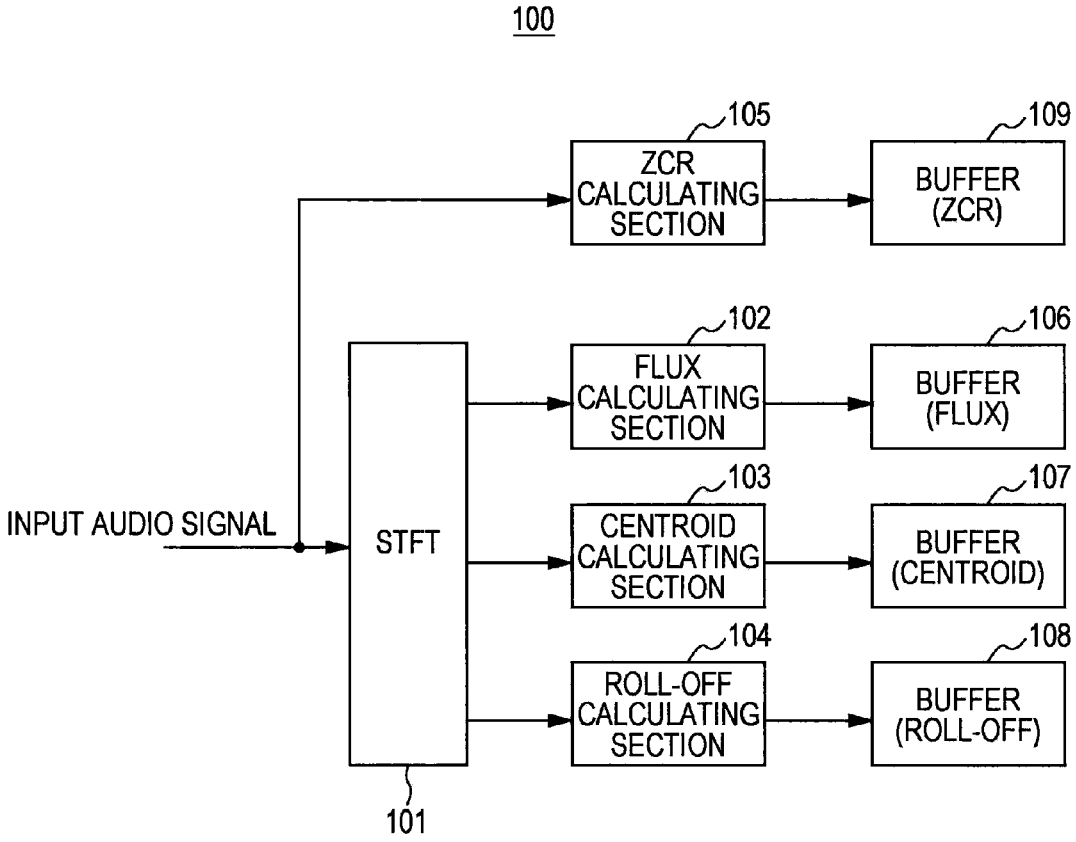
FIG. 2 is a block diagram illustrating an example of a configuration of a basic feature amount extracting section which forms the music tempo detection device.

FIG. 2 illustrates an example of a configuration of the basic feature amount extracting section 100. The basic feature amount extracting section 100 includes a short-time Fourier transform section 101, a flux calculating section 102, a centroid calculating section 103, a roll-off calculating section 104, a ZCR calculating section 105, and buffers 106 to 109.

The ZCR calculating section 105 calculates "ZCR" according to the following formula (1), for each frame (1024 samples) using the input audio signal, that is, data in the time axis. Further, the ZCR calculating section 105 performs normalization so that the calculation result is changed into 1 from 0 in a normalization coefficient determined as the basic feature amount of "ZCR", and stores the result in the buffer 109. Here, "xt" represents sampling data of the input audio signal in a frame t, and "n" represents an index in a time axis direction. Further, "sign" is a function which determines the polarity of the signal. In a case where the signal is positive, "sign" is given "1", and in a case where the signal is negative, "sign" is given "−1". Here, "Zt" is "ZCR" in the frame t.

$$Z_t = \frac{1}{2}\sum_{n=1}^{N} |\mathrm{sign}(x_t[n]) - \mathrm{sign}(x_t[n-1])| \quad (1)$$

The short-time Fourier transform section 101 performs a short-time Fourier transform (STFT) for each frame, for the input audio signal, that is, the data in the time axis. The frequency spectrum for each frame output from the short-time Fourier transform section 101 is used for calculation of the basic feature amounts of "Spectrum Flux", "Spectrum Centroid", and "Roll-Off" for each frame.

The flux calculating section 102 calculates "Spectrum Flux" by the following formula (2), for each frame, using the frequency spectrum for each frame obtained by the short-time Fourier transform section 101. Further, the flux calculating section 102 performs normalization so that the calculation result is changed into 1 from 0 in a normalization coefficient determined as the basic feature amount of "Spectrum Flux", and stores the result in the buffer 106. Here, "N" represents the frequency spectrum (normalized as the total sum of power) of the input audio signal in the frame t, "M" represents the total number of spectrums, and "n" represents an index in a frequency axis direction. Further, "Ft" represents "Spectrum Flux" in the frame t.

$$F_t = \sum_{n=1}^{M} (N_t[n] - N_{t-1}[n])^2 \quad (2)$$

The roll-off calculating section 104 calculates "Roll-Off" for each frame, using the frequency spectrum for each frame obtained by the short-time Fourier transform section 101, and stores the calculation result in the buffer 108. The roll-off calculating section 104 calculates the "Roll-Off" as a minimum Rt which satisfies the following formula (3). Further, the roll-off calculating section 104 performs normalization so that the calculation result is changed into 1 from 0 in a normalization coefficient determined as the basic feature amount of "Roll-Off", and stores the result in the buffer (buffer 4) 108. Here, "X" represents the frequency spectrum of the input audio signal in the frame t, "M" represents the total number of spectrums, and "n" represents an index in a frequency axis direction.

$$\sum_{n=1}^{R_t} X_t[n] > 0.85 * \sum_{n=1}^{M} X_t[n] \quad (3)$$

The centroid calculating section 103 calculates "Spectrum Centroid" for each frame, using the frequency spectrum for each frame obtained by the short-time Fourier transform section 101, according to the following formula (4). Further, the centroid calculating section 103 performs normalization so that the calculation result is changed into 1 from 0 in a normalization coefficient determined as the basic feature amount of "Spectrum Centroid", and stores the result in the buffer 106. Here, "X" represents the frequency spectrum of the input audio signal in the frame t, "M" represents the total number of spectrums, and "n" represents an index in a frequency axis direction. Further, "Ct" represents "Spectrum Centroid" in the frame t.

$$C_t = \frac{\sum_{n=1}^{M} X_t[n] * n}{\sum_{n=1}^{M} X_t[n]} \quad (4)$$

The operation of the basic feature amount extracting section 100 shown in FIG. 2 will be briefly described. The input audio signal (PCM signal) is supplied to the short-time Fourier transform section 101 and the ZCR calculating section 105. The input audio signal is channel transformed and sampling frequency transformed in advance so that the input audio signal is monaural and has a sampling frequency of 22.050 kHz.

The ZCR calculating section 105 calculates the basic feature amount of "ZCR" for each frame (1024 samples) using the input audio signal, that is, data in the time axis (see formula (1)). The ZCR calculating section 105 performs normalization so that the calculation result is changed into 1 from 0 in the normalization coefficient determined as the basic feature amount of "ZCR", and stores the result in the buffer 109 which is a ZCR storing buffer.

Further, the short-time Fourier transform section 101 performs the short-time Fourier transform for each frame for the input audio signal, that is, data in the time axis. The frequency spectrum for each frame obtained by the short-time Fourier transform section 101 is supplied to the flux calculating section 102, the centroid calculating section 103, and the roll-off calculating section 104.

The flux calculating section 102 calculates the basic feature amount of "Spectrum Flux" for each frame, using the frequency spectrum for each frame obtained by the short-time Fourier transform section 101 (refer to formula (2)). The flux calculating section 102 performs normalization so that the calculation result is changed into 1 from 0 in the normalization coefficient determined as the basic feature amount of "Spectrum Flux", and stores the result in the buffer 106 which is a flux storing buffer.

The roll-off calculating section 104 calculates the basic feature amount of "Roll-Off" for each frame, using the frequency spectrum for each frame obtained by the short-time Fourier transform section 101 (refer to formula (3)). The roll-off calculating section 104 performs normalization so that the calculation result is changed into 1 from 0 in the normalization coefficient determined as the basic feature amount of "Roll-Off", and stores the result in the buffer 108 which is a roll-off storing buffer.

The centroid calculating section 103 calculates the basic feature amount of "Spectrum Centroid" for each frame, using the frequency spectrum for each frame obtained by the short-time Fourier transform section 101 (refer to formula (4)). The centroid calculating section 103 performs normalization so that the calculation result is changed into 1 from 0 in the normalization coefficient determined as the basic feature amount of "Spectrum Centroid", and stores the result in the buffer 107 which is a centroid storing buffer.

[Temporary BPM Calculating Section]

Details of the temporary BPM calculating section 200 will be described. As described above, the temporary BPM calculating section 200 considers the basic feature amounts of the plurality of types for each frame as time series data, and extracts the periodic component (repetitive component) included in the weighted addition signal of the basic feature amounts of the plurality of types, to thereby calculate the temporary BPM.

Figure 3:
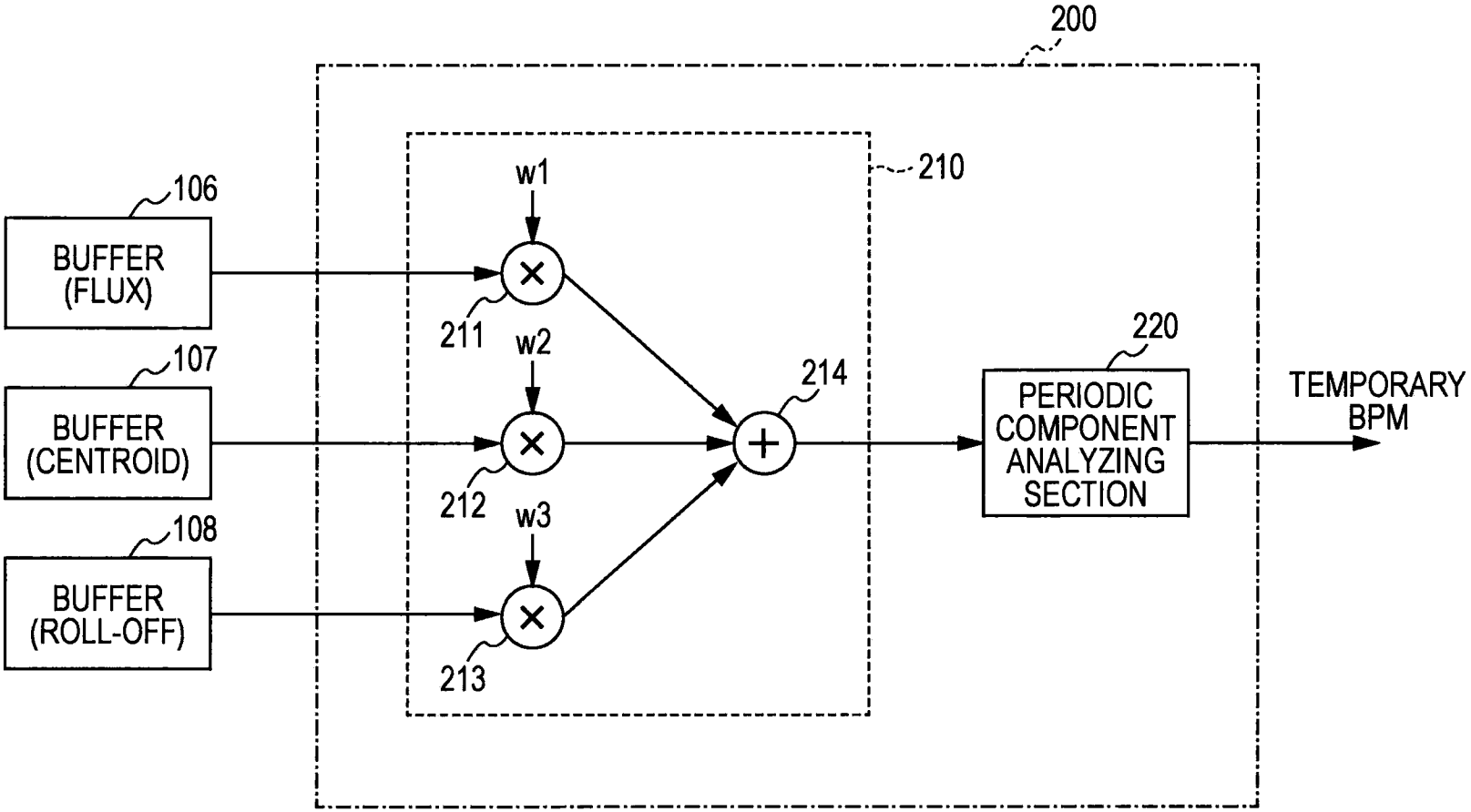
FIG. 3 is a block diagram illustrating an example of a configuration of a temporary BPM calculating section which forms the music tempo detection device.

FIG. 3 illustrates an example of a configuration of the temporary BPM calculating section 200. The temporary BPM calculating section 200 includes a weighting and adding section 210 and a periodic component analyzing section 220. The weighting and adding section 210 sequentially extracts the basic feature amounts of "Spectrum Flux", "Spectrum Centroid", and "Roll-Off" for the respective frames from the buffers 106, 107, and 108 and performs weighting and addition, to thereby obtain a weighted addition signal.

The weighting and adding section 210 includes multipliers 211 to 213 and an adder 214. The multiplier 211 multiplies "Spectrum Flux" extracted from the buffer 106 by a weight coefficient w1, to perform weighting. Further, the multiplier 212 multiplies "Spectrum Centroid" extracted from the buffer 107 by a weight coefficient w2, to perform weighting. Further, the multiplier 213 multiplies "Roll-Off" extracted from the buffer 108 by a weight coefficient w3, to perform weighting.

The adder 214 adds the basic feature amounts of "Spectrum Flux", "Spectrum Centroid", and "Roll-Off" for the respective frames weighted by the multipliers 211, 212, and 213, respectively, to sequentially output the weighted addition signals for the respective frames. The weight coefficients w1, w2, and w3 are manually determined in advance or automatically determined by learning or the like so that the periodic component is desirably detected.

All the basic feature amounts of "Spectrum Flux", "Spectrum Centroid", and "Roll-Off" tend to increase in locations where an attacking signal is generated. In view of an individual basic feature amount, since the basic feature amount increases in locations other than the focused periodic component, there are many cases where this becomes noise at the time of detection of the periodic component, which causes an error of the periodic component detection. In the weighted addition signal, since a location where all the basic feature amounts are changed at the same time is emphasized, it is possible to reduce noise, to thereby improve the detection performance of the periodic component.

Figure 4:
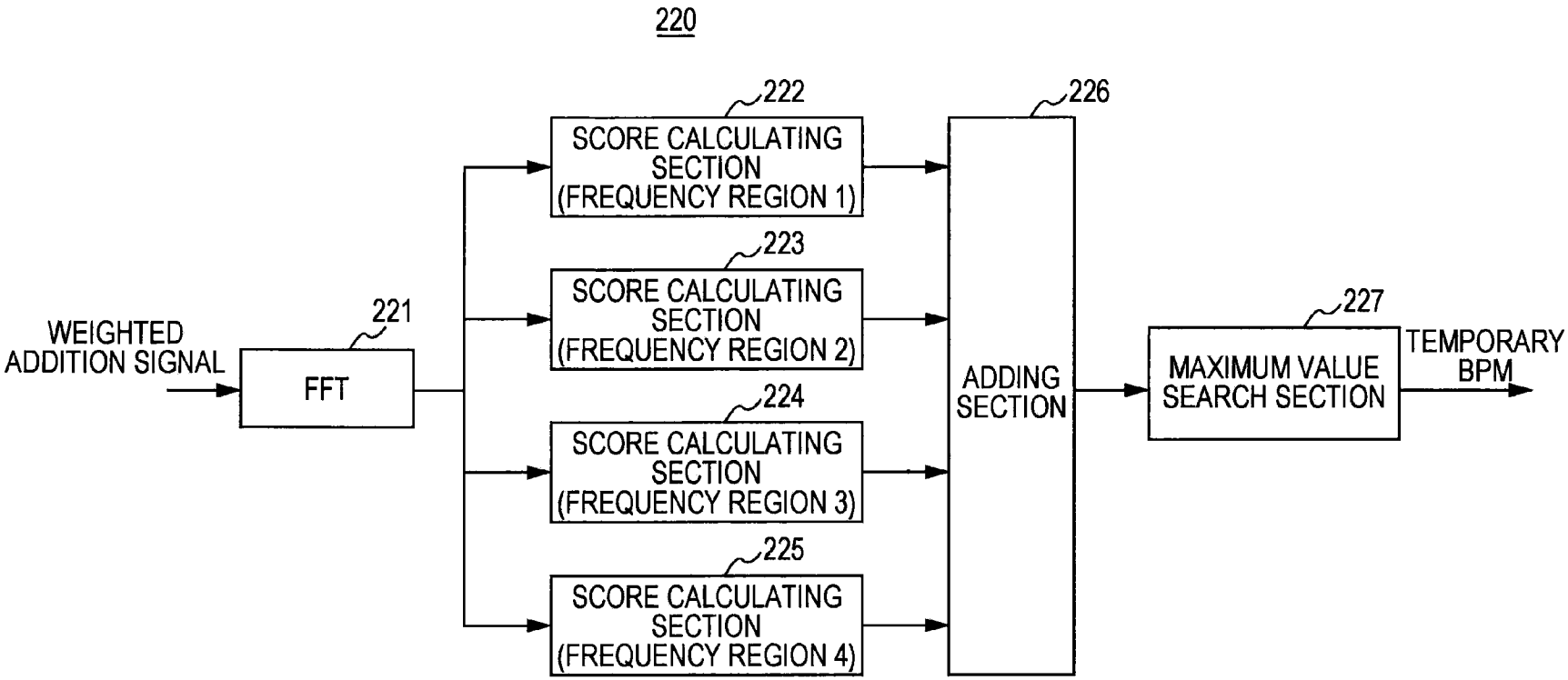
FIG. 4 is a block diagram illustrating an example of a configuration of a period component analyzing section which forms the temporary BPM calculating section.

The periodic component analyzing section 220 detects the periodic component (repetitive component) included in the weighted addition signal obtained by the weighting and adding section 210, and detects a temporary BPM on the basis of the periodic component. The periodic component analyzing section 220 forms a tempo detecting section. FIG. 4 illustrates an example of a configuration of the periodic component analyzing section 220. The periodic component analyzing section 220 includes a fast Fourier transform section 221, score calculating sections 222 to 225, an adding section 226, and a maximum value search section 227.

The fast-Fourier transform section 221 performs the fast Fourier transform (FFT) for the weighted addition signals for the respective frames sequentially output from the weighting and adding section 210. The size of the FFT corresponds to 1024 samples, for example. In this case, in the time series data, since the number of frames per second is 22050/1024, the sampling frequency when the time series data is fast Fourier transformed becomes 22050/1024 Hz. The Nyquist frequency at that time becomes 22050/(2×1024) Hz. In a case where 1024 samples are used as the size of FFT, frequency data of 1024 samples is obtained, and one sample corresponds to (22050/1024)/1024 Hz. Since the BPM corresponds to the number of repetitions per minute, one sample corresponds to 60×(22050/1024)/1024 BPM for each spectrum, in other words.

Figure 5:
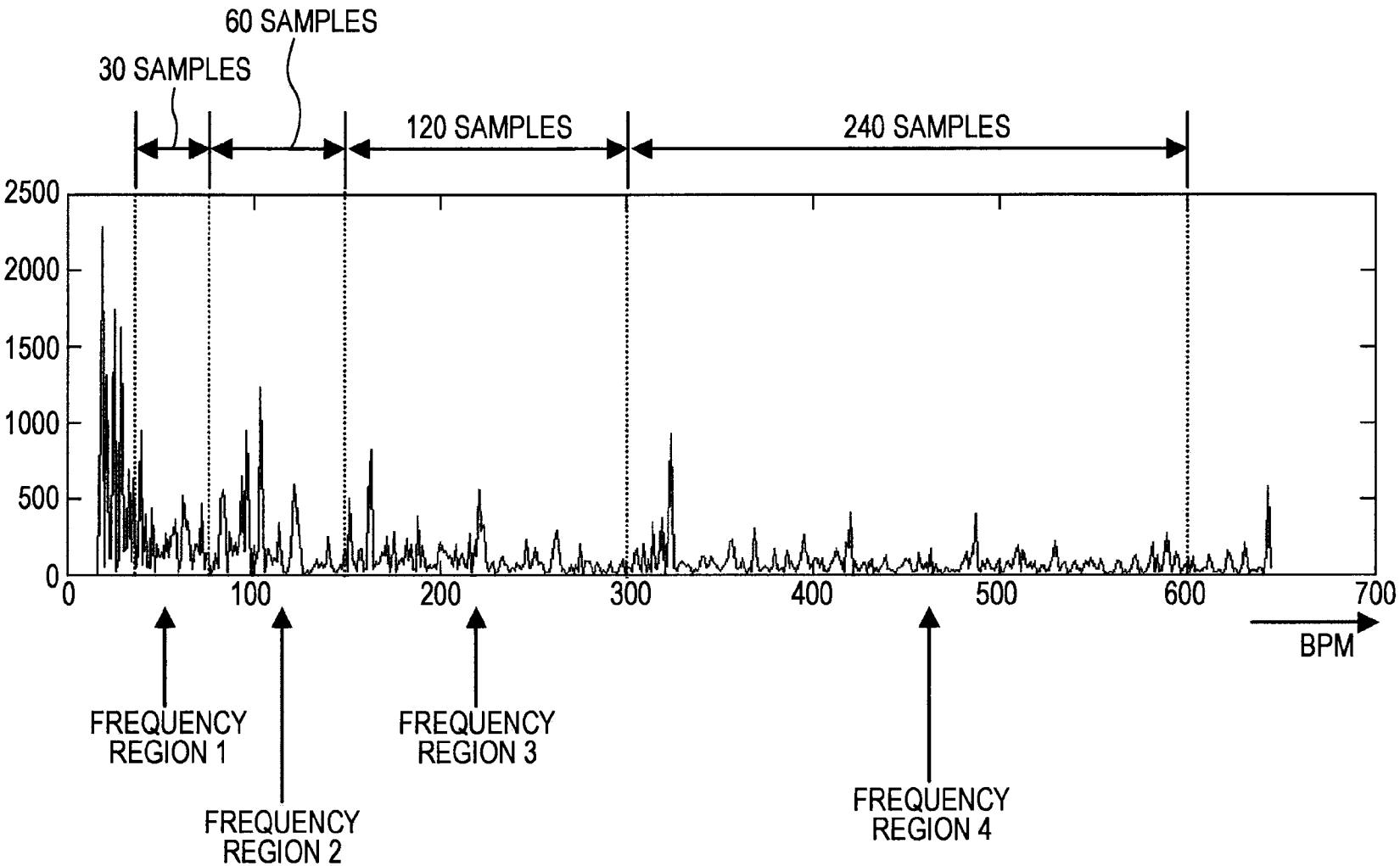
FIG. 5 is a diagram illustrating an example of a result obtained by performing the fast Fourier transform for a weighted addition signal of a plurality of types of basic feature amounts.

In a case where the periodic component is present in the weighted addition signal, the level of sampling data of a corresponding frequency location, among each sample data in the frequency axis obtained as a result of the fast Fourier transform, becomes the peak. FIG. 5 illustrates an example of a result of the fast Fourier transform of the weighted addition signal. In this figure, the longitudinal axis represents the BPM (Beats Per Minute) corresponding to the frequency.

The score calculating sections 222 to 225 calculate scores for detection of the temporary BPM. As apparent from the result of the fast Fourier transform in FIG. 5, some peaks appear. The frequency location where the maximum value occurs is not necessarily limited to the correct BPM. For example, in a case where a sixteenth note component is strong, a strong peak appears in a location that is four times the correct BPM.

Before performing a correct BPM detection, the temporary BPM calculating section 200 detects the BPM when it is assumed that the correct BPM is BPM0 to BPM0×2 (BPM0 is about 75) as the temporary BPM. The score detecting sections 222 to 225 calculate a score indicating which BPM among BPM0 to BPM0×2 looks most like the temporary BPM, from the result of the fast-Fourier transform, in order to calculate the temporary BPM.

In a case where a piece of music of BPM=100 is processed, a peak is generated to a frequency corresponding to BPM=100 and also peaks tend to be generated in frequency locations corresponding to BPM=50, BPM=200, and BPM=400. Thus, the periodic component analyzing section 220 divides the frequency region into the following four regions, and calculates scores in the respective regions. In the frequency division, the score is reduced to one half in a frequency region adjacent to a low pass side, and is doubled in a frequency region adjacent to a high pass side.

In a case where a lower limit value of the temporary BPM is set as BPM0, a frequency region 1 is a frequency region corresponding to BPM0/2<BPM≦BPM0, a frequency region 2 is a frequency region corresponding to BPM0<BPM≦BPM0×2, a frequency region 3 is a frequency region corresponding to BPM0×2<BPM≦BPM0×4, and a frequency region 4 is a frequency region corresponding to BPM0×4<BPM≦BPM0×8. If the range of the temporary BPM is set to about 75 to about 150, the BPM0 becomes 60×(22050/1024)/1024×60.

The score calculating section 222 calculates the score of the frequency region 1 on the basis of each sample data existing in the frequency region 1. The score calculating section 223 calculates the score of the frequency region 2 on the basis of each sample data existing in the frequency region 2. The score calculating section 224 calculates the score of the frequency region 3 on the basis of each sample data existing in the frequency region 3. The score calculating section 225 calculates the score of the frequency region 4 on the basis of each sample data existing in the frequency region 4.

Figure 6:
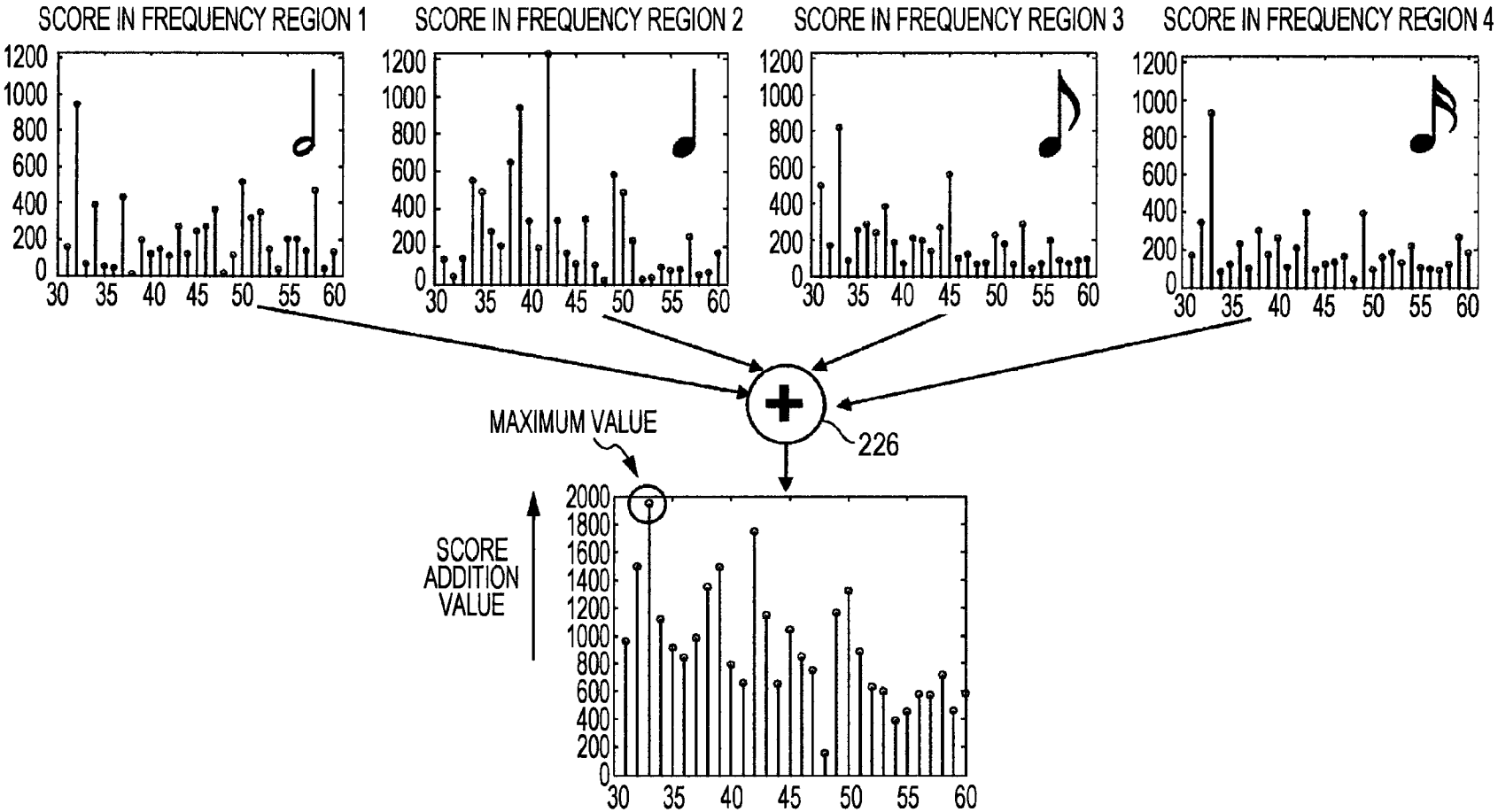
FIG. 6 is a diagram illustrating a score calculation example of each frequency region using a fast Fourier transform result.

FIG. 6 illustrates an example of the score calculations of each frequency region using the result (refer to FIG. 5) of the fast-Fourier transform. A signal of the frequency region 1 is considered as a component of one half of the temporary BPM corresponding to the location where the frequency is double. That is, the signal of the frequency region 1 becomes a half note component in a case where the temporary BPM is considered as a quarter note. Thus, the score calculating section 222 which calculates the score of the frequency region 1 uses its level as a sample score in the location where the frequency is double, for each sample data existing in the frequency region 1. For example, the level of sample data existing in a location where BPM is 60 is used as a sample score corresponding to BPM=120.

The signal of the frequency region 2 is considered as the component of the temporary BPM. That is, the signal of the frequency region 2 becomes a quarter note component in a case where the temporary BPM is considered as the quarter note. Thus, the score calculating section 223 which calculates the score of the frequency region 2 uses its level as a sample score in a location where the frequency is the same, for each sample data existing in the frequency region 2.

The signal of the frequency region 3 is considered as a component of double the temporary BPM corresponding to a location where the frequency is one half. That is, the signal of the frequency region 3 becomes an eighth note component in a case where the temporary BPM is considered as the quarter note. Thus, the score calculating section 224 which calculates the score of the frequency region 3 uses its level as a sample score in a location where the frequency is one half, for each sample data existing in the frequency region 3. For example, the level of the sample data existing in a location where the BPM is 240 is used as a sample score corresponding to BPM=120.

The signal of the frequency region 4 is considered as a component quadruple the temporary BPM corresponding to a location where the frequency is 1/4. That is, the signal of the frequency region 4 becomes a sixteenth note component in a case where the temporary BPM is considered as the quarter note. Thus, the score calculating section 225 which calculates the score of the frequency region 4 uses its level as a sample score in a location where the frequency is 1/4, for each sample data existing in the frequency region 4. For example, the level of the sample data existing in a location where the BPM is 480 is used as a sample score corresponding to BPM=120.

Returning to FIG. 4, the adding section 226 matches the sample numbers in the respective regions, and adds the scores in the respective regions calculated by the score calculating sections 222 to 225 for the corresponding samples. The adding section 226 forms a score adding section. The adding section 226 performs thinning out of the samples in the other frequency regions so that their sample numbers become the same as in the frequency region 1 in which the sample number is smallest, for example.

As described above, in a case where the frame frequency is 22.050/1024 kHz and the FFT size is 1024 samples, in the fast-Fourier transform section 221, the sampling frequency is 22.050/1024 kHz and a frequency expression where the sample number (data number) is 1024 is obtained. In this case, the sample number of the frequency region 1 is 30, the sample number of the frequency region 2 is 60, the sample number of the frequency region 3 is 120, and the sample number of the frequency region 4 is 240 (refer to FIG. 5).

The thinning out of the samples in the frequency region 2 is performed as follows. While the sample number in the frequency region 1 is 30, the sample number in the frequency region 2 is 60. Thus, the adding section 226 divides the frequency region 2 into 30 blocks every two samples, and takes only maximum value of each block, to thereby thin out the samples to 30 samples.

Further, the sample thinning out in the frequency region 3 is performed as follows. While the sample number of the frequency region 1 is 30, the sample number of the frequency region 3 is 120. Thus, the adding section 226 divides the frequency region 3 into 30 blocks for every 4 samples, and takes only the maximum value of each block, to thereby thin out the samples to 30 samples.

Further, the sample thinning out in the frequency region 4 is performed as follows. While the sample number of the frequency region 1 is 30, the sample number of the frequency region 4 is 240. Thus, the adding section 226 divides the frequency region 4 into 30 blocks for every 8 samples, and takes only the maximum value of each block, to thereby thin out the samples to 30 samples.

The maximum value search section 227 searches for a maximum value from score addition values of the respective samples which are obtained by the addition in the adding section 226, as shown in FIG. 6. Further, the BPM corresponding to the frequency in the frequency region 2, which corresponds to the samples of the maximum score addition value, is used as the temporary BPM. Here, the frequency region 2 (frequency region corresponding to BPM0<BPM≦BPM0×2) is the frequency region where it is assumed that the correct BPM is present, as described above.

An operation of the temporary BPM calculating section 200 shown in FIG. 3 will be briefly described. The basic feature amounts of "Spectrum Flux", "Spectrum Centroid", and "Roll-Off" for the respective frames which are stored in the buffers 106, 107, and 108 are sequentially extracted, and then are supplied to the weighting and adding section 210. The multiplier 211 multiplies "Spectrum Flux" extracted from the buffer 106 by the weight coefficient w1, to perform weighting. Further, the multiplier 212 multiplies "Spectrum Centroid" extracted from the buffer 107 by the weight coefficient w2, to perform weighting. Further, the multiplier 213 multiplies "Roll-Off" extracted from the buffer 108 by the weight coefficient w3, to perform weighting.

The output signals of the respective multipliers 211 to 213 are supplied to the adder 214. The adder 214 adds the basic feature amounts of "Spectrum Flux", "Spectrum Centroid", and "Roll-Off" for the respective frames weighted by the multipliers 211 to 213, respectively, to sequentially obtain the weighted addition signals for the respective frames. The weighted addition signals are supplied to the periodic component analyzing section 220.

The periodic component analyzing section 220 detects the periodic component (repetitive component) included in the weighted addition signal obtained by the weighting and adding section 210, and detects the temporary BPM on the basis of the periodic component. That is, the Fourier transform section 221 of the periodic component analyzing section 220 performs the fast-Fourier transform for the weighted addition signals (time series data) of the respective frames which are sequentially output from the weighting and adding section 210 (refer to FIG. 4). The result of the fast-Fourier transform is supplied to the score calculating sections 222 to 225 (refer to FIG. 5).

The score calculating sections 222 to 225 calculate scores for detecting the temporary BPM (refer to FIG. 6). The score calculating section 222 calculates the score of the frequency region 1 on the basis of each sample data existing in the frequency region 1 (frequency region corresponding to BPM0/2<BPM≦BPM0). In this case, the level becomes a sample score in a location where the frequency is double, for each sample data existing in the frequency region 1.

The score calculating sections 223 calculates the score of the frequency region 2 on the basis of each sample data existing in the frequency region 2 (frequency region corresponding to BPM0<BPM≦BPM0×2). The frequency region 2 is the frequency region where it is assumed that the correct BPM is present. In this case, the level becomes a sample score in a location where the frequency is the same, for each sample data existing in the frequency region 2.

The score calculating sections 224 calculates the score of the frequency region 3 on the basis of each sample data existing in the frequency region 3 (frequency region corresponding to BPM0×2<BPM≦BPM0×4). In this case, the level becomes a sample score in a location where the frequency is one half, for each sample data existing in the frequency region 3.

The score calculating sections 225 calculates the score of the frequency region 4 on the basis of each sample data existing in the frequency region 4 (frequency region corresponding to BPM0×4<BPM≦BPM0×8). In this case, the level becomes a sample score in a location where the frequency is 1/4, for each sample data existing in the frequency region 4.

The scores of the respective frequency regions calculated by the score calculating sections 222 to 225 are supplied to the adding section 226. The adding section 226 matches the sample numbers in the respective frequency regions, and adds the scores of the respective frequency regions for the corresponding samples, respectively. In this case, the adding section 226 performs thinning out of the samples in the other frequency regions so that their sample numbers become the same as in the frequency region 1 in which the sample number is smallest, for example.

The score addition value of the samples obtained by the adding section 226 is supplied to the maximum value search section 227 (see FIG. 6). The maximum value search section 227 searches for the maximum value from score addition values of the respective samples. Further, in the maximum value search section 227, the BPM corresponding to the frequency in the frequency region 2, which corresponds to the samples of the maximum score addition value, is used as the temporary BPM.

[BPM Calculating Section]

Details of the BPM calculating section 200 will be described. The BPM calculating section 200 calculates the sense of speed on the basis of the basic feature amounts extracted by the basic feature amount extracting section 100, and determines whether the temporary BPM calculated by the temporary BPM calculating section 200 should be modified. The temporary BPM calculating section 200 calculates the temporary BPM on the basis of the assumption that the BPM falls in BPM0 to BPM0×2. The BPM calculating section 300 performs a high BPM determination (determine whether the BPM exceeds BPM0×2) and a low BPM determination (determine whether the BPM is lower than BPM0), to thereby obtain more accurate BPM.

As described above, the music tempo detection device 10 detects the BPM representing the tempo of music, for example, every 30 seconds for the audio signal. The BPM calculating section 300 further divides the signal for the 30 seconds into blocks for several 100 msec, and performs the high BPM determination and low BPM determination for each block. The BPM calculating section 300 uses the basic feature amounts of "ZCR", "Spectrum Flux", "Spectrum Centroid", and "Roll-Off" extracted by the basic feature amount extracting section 100 in the above-mentioned determinations.

As described above, the basic feature amount extracting section 100 extracts the basic feature amounts of "ZCR", "Spectrum Flux", "Spectrum Centroid", and "Roll-Off" for each frame, from the input audio signal (PCM signal). The BPM calculating section 300 calculates averages and standard deviations of the respective basic feature amounts for each block, and uses the result as feature amounts representing the block. Consequently, the BPM calculating section 300 obtains eight-dimensional feature vectors (f0, f1, f2, f3, f4, f5, f6, and f7) as the feature amounts. The BPM calculating section 300 calculates the inner product of the feature vectors and weight coefficients, to thereby perform the high BPM determination and low BPM determination.

Firstly, the BPM calculating section 300 performs the high BPM determination, that is, determines whether the BPM exceeds BPM0×2. The BPM calculating section 300 calculates a "speed sense 1" for the high BPM determination, using the above-mentioned eight-dimensional feature vectors and the weight coefficients for the high BPM determination.

The weight coefficients for the high BPM determination are calculated by learning in advance. The learning is performed as follows, for example. That is, a group of music when a person feels that the BPM exceeds BPM0×2 and a group of music when a person feels that the BPM is lower than BPM0×2 are prepared, and the above-mentioned feature amounts (eight dimensional feature vectors) are calculated for all the music in each group. Further, Fisher's linear discriminant analysis is used, and an optimal projection for discriminating two groups is calculated. Coefficients obtained as a result are used as the weight coefficients for the high BPM determination.

The "speed sense 1" corresponds to a degree where a person feels that the BPM exceeds BPM0×2. The BPM calculating section 300 calculates the "speed sense 1" in a block k, by calculating the inner product of the feature amounts (eight-dimensional feature vectors) and the weight coefficients for the high BPM determination according to the following formula (5). Here, "a" represents the weight coefficients for the high BPM determination for the calculation of the "speed sense 1", and "f" represents the feature amounts in the block k.

$$S_1(k) = \sum_{i=0}^{7} a_i f_i(k) \tag{5}$$

The BPM calculating section 300 compares the calculated "speed sense 1" with a predetermined threshold A. When the "speed sense 1" is greater than the threshold A, the BPM calculating section 300 determines the BPM as double the temporary BPM, that is, "temporary BPM×2". When the "speed sense 1" is not greater than the threshold A, the BPM calculating section 300 moves to the low BPM determination. The threshold A is determined at the time of the learning of the weight coefficients for the high BPM determination.

In order to perform the low BPM determination, that is, to determine whether the BPM is lower than BPM0, the BPM calculating section 300 calculates a "speed sense 2" using the above-mentioned eight-dimensional feature vectors and the weight coefficients for the low BPM determination.

The weight coefficients for the low BPM determination are determined by learning in advance. The learning is performed as follows, for example. That is, a group of music when a person feels that the BPM is lower than BPM0 and a group of music when a person feels that the BPM is BPM0 or higher, are prepared, and the above-mentioned feature amounts (eight-dimensional feature vectors) are calculated for all the music in each group. Further, the Fisher's linear discriminant analysis is used, and an optimal projection for discriminating two groups is calculated. Coefficients obtained as a result are used as the weight coefficients for the low BPM determination.

The "speed sense 2" corresponds to a degree where the person feels that the BPM is lower than BPM0. The BPM calculating section 300 calculates the "speed sense 2" in a block k, by calculating the inner product of the feature vectors (eight-dimensional feature vectors) and the weight coefficients for the low BPM determination according to the following formula (6). Here, "b" represents the weight coefficients for the low BPM determination for the calculation of the "speed sense 2", and "f" represents the feature amounts in the block k.

$$S_2(k) = \sum_{i=0}^{7} b_i f_i(k) \tag{6}$$

The BPM calculating section 300 compares the calculated "speed sense 2" with a predetermined threshold B. When the "speed sense 2" is greater than the threshold B, the BPM calculating section 300 determines the BPM as half the temporary BPM, that is, "temporary BPM/2". When the "speed sense 2" is not greater than the threshold B, the BPM calculating section 300 determines the BPM as the temporary BPM.

Figure 7:
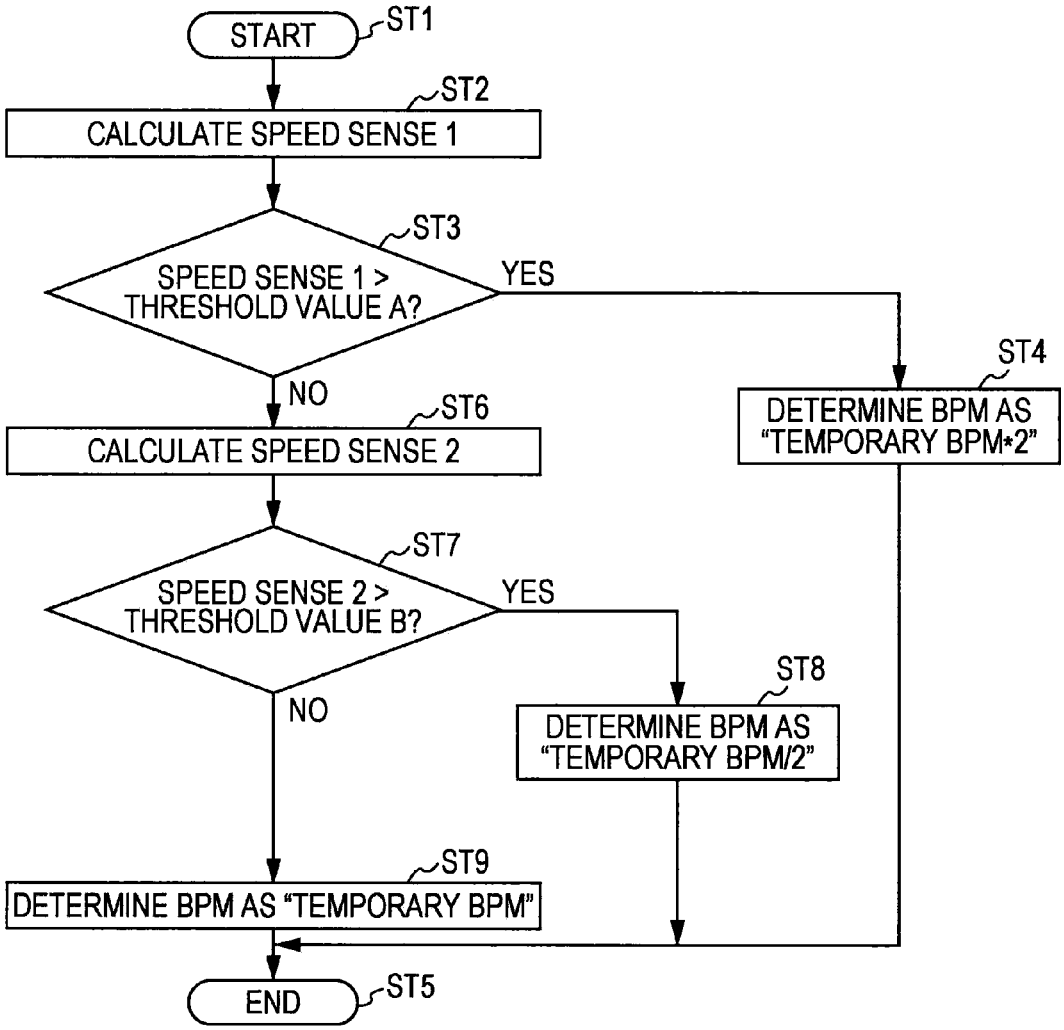
FIG. 7 is a flowchart illustrating a procedure of a BPM determination process of each block in a BPM calculating section.

FIG. 7 is a flowchart illustrating a procedure of the above-described BPM determination process for each block, in the BPM calculating section 300. The BPM calculating section 300 starts the process in step ST1, and then proceeds to step ST2. In step ST2, the BPM calculating section 300 calculates the inner product of the feature amounts (eight-dimensional feature vectors) and the weight coefficients for the high BPM determination, to thereby calculate the "speed sense 1" for the high BPM determination (refer to formula (5)).

Next, in step ST3, the BPM calculating section 300 determines whether the "speed sense 1" is greater than the threshold A, that is, "speed sense 1">threshold value A. When the "speed sense 1" is greater than the threshold value A, in step ST4, the BPM calculating section 300 determines the BPM as double the temporary BPM, that is, as "temporary BPM×2", and then terminates the process in step ST5.

When the "speed sense 1" is not greater than the threshold A in step ST3, the BPM calculating section 300 proceeds to the process of step ST6. In step ST6, the BPM calculating section 300 calculates the inner product of the feature amounts (eight-dimensional feature vectors) and the weight coefficients for the low BPM determination, to thereby calculate the "speed sense 2" for the low BPM determination (refer to formula (6)).

Next, in step ST7, the BPM calculating section 300 determines whether the "speed sense 2" is greater than the threshold B, that is, "speed sense 2">threshold value B. When the speed sense 2 is greater than the threshold value B, in step ST8, the BPM calculating section 300 determines the BPM as one half of the temporary BPM, that is, as "temporary BPM/2", and then terminates the process in step ST5.

When the "speed sense 2" is not greater than the threshold B in step ST7, the BPM calculating section 300 proceeds to the process of step ST9. In step ST9, the BPM calculating section 300 determines the BPM as the temporary BPM as it is, and then terminates the process in step ST5.

As described above, the BPM calculating section 300 divides the signal for 30 seconds into blocks for several 100 msec, and performs the high BPM determination and the low BPM determination for each block to determine the BPM. The BPM calculating section 300 outputs the most frequent block among all the blocks, as the BPM of the input audio signal for 30 seconds which is currently processed.

In the above-described high BPM determination and low BPM determination in the BPM calculating section 300, it is possible to combine a plurality of determining devices. For example, a system which considers the BPM as BPM0×2 or higher and modifies the BPM into double in a case where a value which is equal to or higher than the threshold is obtained in any determining device, a system which considers the BPM as being less than BPM0 and modifies the BPM into one half in a case where a value which is equal to or higher than the threshold is obtained in all the determining devices, or the like, are considered.

Further, as described above, the above-described music tempo detection device 10 detects the BPM representing the tempo of music per the predetermined time, for example, every 30 seconds, for the audio signal. Thus, in order to determine the BPM of the entire piece of music, it is necessary to combine the results for all 30 seconds. This process is realized by considering the BPM having the most frequent appearance from among the BPMs for all 30 seconds as the BPM of the entire piece of music, for example.

As described above, in the music tempo detection device 10 in FIG. 1, the basic feature amounts of "Spectrum Flux", "Spectrum Centroid", and "Roll-Off" extracted from the input audio signal are weighted and added in the temporary BPM calculating section 200. Further, the temporary BPM representing the tempo is calculated on the basis of the weighted addition signal. In the weighted addition signal, since a location where all the basic feature amounts are changed at the same time is emphasized, it is possible to reduce noise, to thereby enhance the detection performance of the periodic component. Accordingly, it is possible to calculate the temporary BPM in a low calculation amount with high efficiency by the temporary BPM calculating section 200.

Further, in the music tempo detection device 10 in FIG. 1, the BPM calculating section 300 calculates the "speed sense 1" and the "speed sense 2" from the basic feature amounts of "ZCR", "Spectrum Flux", "Spectrum Centroid", and "Roll-Off". Further, the temporary BPM calculated by the temporary BPM calculating section 200 is appropriately modified on the basis of the "speed sense 1" and the "speed sense 2". Further, the basic feature amounts of "ZCR", "Spectrum Flux", "Spectrum Centroid", and "Roll-Off" used in the BPM calculating section 300 are extracted by the basic feature amount extracting section 100. Accordingly, it is possible to obtain the BPM in a low calculation amount with high efficiency by the BPM calculating section 300.

Further, in the music tempo detection device 10 in FIG. 1, since the BPM can be detected in a low calculation amount with high efficiency, it is possible to detect the music tempo with high efficiency even on a portable device capable of being mounted with only a low resource processor. Accordingly, even in an environment in which it is difficult to use a PC application, it is possible to provide a function using the music tempo such as a music search based on the tempo.

2. Second Embodiment

[Music Analysis System]

Figure 8:
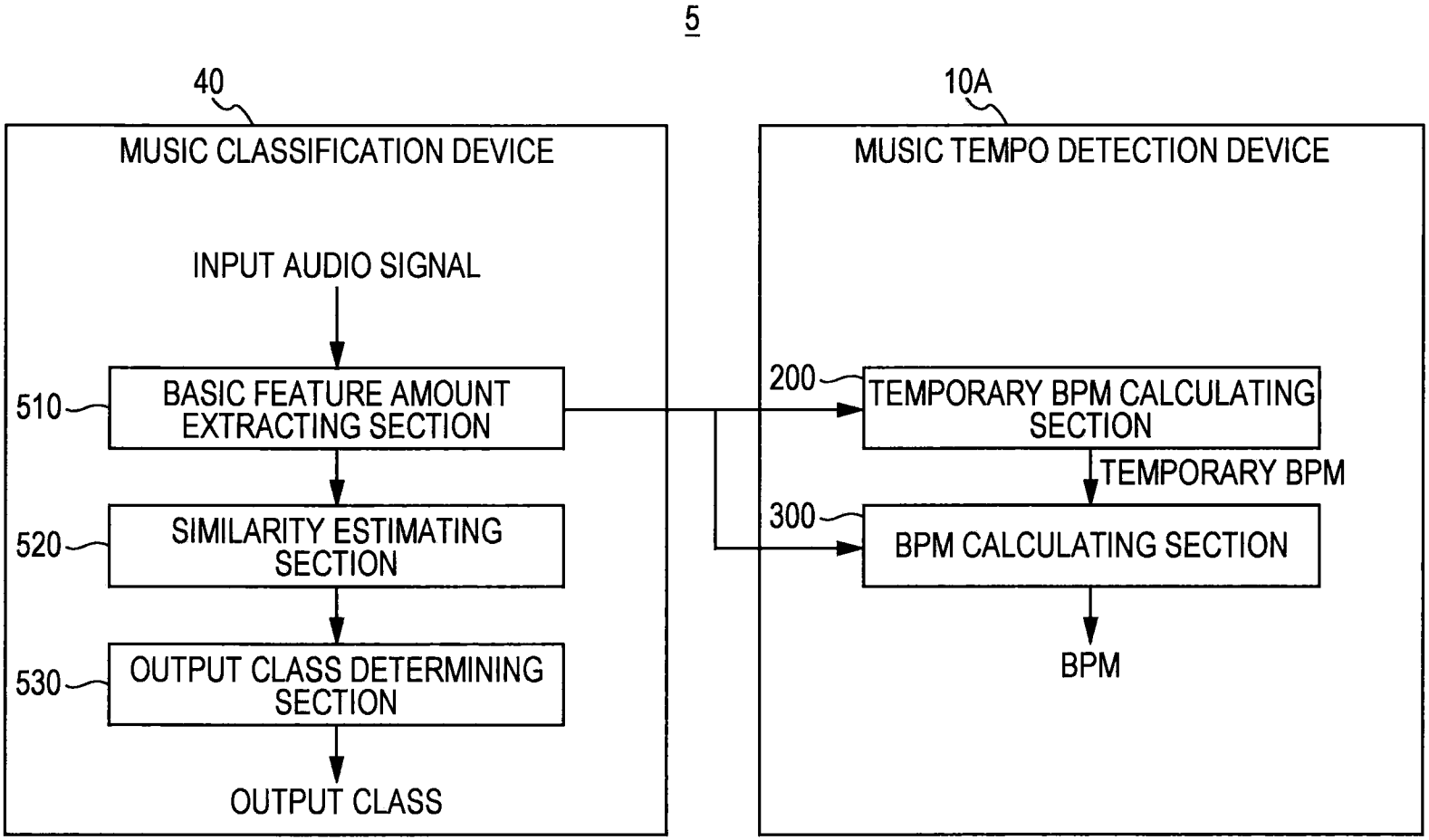
FIG. 8 is a block diagram illustrating an example of a configuration of a music analysis system according to a second embodiment of the present disclosure.

FIG. 8 illustrates an example of a configuration of a music analysis system 5 according to a second embodiment of the present disclosure. In FIG. 8, the same reference numerals are given to elements corresponding to FIG. 1.

The music analysis system 5 performs music classification and music tempo detection at the same time. In the music classification, the music analysis system 5 classifies music into classes including genres such as classical, rock, or jazz, and moods such as happy music or sad music on the basis of the input audio signal, and outputs a classification class "output class". In the music tempo detection, the BPM representing the tempo of music is detected on the basis of the input audio signal to be output, in a similar way to the above-described first embodiment.

The music analysis system 5 includes a music classification device 40 and a music tempo detection device 10A. The music classification device 40 will be firstly described. The music classification device 40 includes a basic feature amount extracting section 510, a similarity estimating section 520, and an output class determining section 530.

The basic feature amount extracting section 510 calculates a plurality of types of basic feature amounts, for each frame, from an input audio signal (PCM signal). A detailed description of the basic feature amount extracting section 510 is omitted, but is configured in a similar way to the basic feature amount extracting section 100 of the music tempo detection device 10 in FIG. 1.

The similarity estimating section 520 calculates the similarity with a model indicating a classification class, using the basic feature amounts for each frame extracted by the basic feature amount extracting section 510. Here, a likelihood calculation which uses GMM (Gaussian Mixture Model) is performed as the similarity calculation. In order to perform the likelihood calculation, a database including music which is to be classified into each class is created as learning data in advance.

After the feature amounts are calculated for the learning data in learning, modeling using the GMM is performed for each class. It is possible to use an EM algorithm for the modeling. The modeling may be performed offline, and parameters representing respective models are stored in the similarity estimating section 520.

The similarity estimating section 520 calculates the log likelihoods for the models for the respective frames using the GMM parameters representing the respective classes. After the processes for all the frames are terminated, the total sum of the log likelihoods of all the frames is taken to be used as scores for the respective modes and genres. The output class determining section 530 outputs the class having the largest score as the process result, that is, a classification class "output class".

Next, the music tempo detection device 10A will be described. The music tempo detection device 10A includes a temporary BPM calculating section 200 and a BPM calculating section 300. Detailed description thereof is omitted, but the temporary BPM calculating section 200 and the BPM calculating section 300 are the same as the temporary BPM calculating section 200 and the BPM calculating section 300 in the music tempo detection device 10 in FIG. 1.

The temporary BPM calculating section 200 in the music tempo detection device 10A weights and adds the basic feature amounts of "Spectrum Flux", "Spectrum Centroid", and "Roll-Off" extracted by the basic feature amount extracting section 510 of the music classification device 40. Further, the temporary BPM calculating section 200 calculates the temporary BPM representing the tempo on the basis of the weighted addition signal.

Further, the BPM calculating section 300 in the music tempo detection device 10A calculates a "speed sense 1" and a "speed sense 2" on the basis of the basic feature amounts extracted by the basic feature amount extracting section 510 of the music classification device 40. In this case, the basic feature amounts of the "ZCR", "Spectrum Flux", "Spectrum Centroid", and "Roll-Off" are used. The BPM calculating section 300 appropriately modifies the temporary BPM calculated by the temporary BPM calculating section 200 on the basis of the "speed sense 1" and the "speed sense 2", to output the BPM.

In the music analysis system 5 shown in FIG. 8, since the music tempo detection device 10A has the same configuration as that of the music tempo detection device 10 shown in FIG. 1, it is possible to obtain the same effect. Further, in the music analysis system 5, the basic feature amounts extracted by the basic feature amount extracting section 510 of the music classification device 40 can be effectively used in the music tempo detection device 10A. Thus, it is possible to reduce the entire calculation amount.

Although not shown in FIG. 8, the music classification device 40 may use the BPM which is the analysis result of the music tempo detection device 300 as the feature amounts. For example, a lower limit and an upper limit of the BPM are determined for each class, and the output class determining section 530 may finally output the classification class "output class" only for music that falls in the range thereof.

3. Modifications

Figure 9:
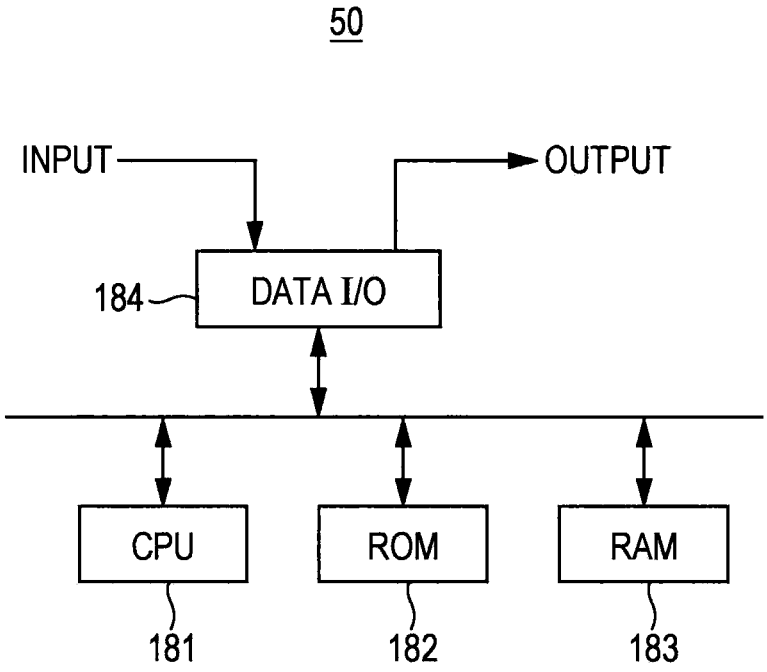
FIG. 9 is a diagram illustrating an example of a configuration of a computer device which allows a process such as music tempo detection or music classification to be executed using software.

The above-described music tempo detection device 10 and the music analysis system 5 may be configured by hardware, and may perform the same process using software. FIG. 9 illustrates an example of a configuration of a computer device 50 which allows the process to be executed using software. The computer device 50 includes a CPU 181, a ROM 182, a RAM 183 and a data input/output section (data I/O) 184.

The ROM 182 stores necessary data such as a process program of the CPU 181, weight coefficients, and thresholds. The RAM 183 functions as a work area of the CPU 181. The CPU 181 reads out the process program stored in the ROM 182 as necessary, transmits the read process program to the RAM 183 for expansion, and reads out the expanded process program to perform a process such as music tempo detection or music classification.

In the computer device 50, a music audio signal (PCM signal) is input through the data I/O 184, and is stored in the RAM 183. A process such as music tempo detection or music classification is performed for the input audio signal stored in the RAM 183 by the CPU 181. Further, the process result (BPM, output class) is output outside through the data I/O 184, as necessary.

The above-described embodiments illustrate only the music tempo detection device 10 and the music analysis system 5. The music tempo detection device 10 and the music analysis system 5 may be mounted and used in a portable device such as a mobile communication device or terminal or a mobile information device or terminal with a sound recording and reproducing function.

The present disclosure contains subject matter related to that disclosed in Japanese Priority Patent Application JP 2010-173253 filed in the Japan Patent Office on Aug. 2, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A tempo detection device comprising:

a basic feature amount extracting section which extracts a plurality of types of basic feature amounts from an input audio signal;

a weighting and adding section which weights and adds the basic feature amounts of the plurality of types extracted in the basic feature amount extracting section to obtain an addition signal; and a tempo detecting section which detects BPM indicating the tempo on the basis of a periodic component included in the addition signal obtained in the weighting and adding section, wherein the tempo detecting section includes:

a fast Fourier transform section which performs a fast Fourier transform for the addition signal for each frame obtained in the weighting and adding section;

a score calculating section which divides respective samples in a frequency axis output from the fast Fourier transform section into a predetermined number of continuous frequency regions, which include a frequency region in which it is assumed that a correct BPM is present, and in which a frequency region adjacent to a low pass side becomes one half and a frequency region adjacent to a high pass side becomes double, and calculates a score corresponding to the level of each sample data for each frequency region and for each sample;

a score adding section which matches the numbers of samples of the respective frequency regions and adds the sample scores of the respective frequency regions for the corresponding samples, on the basis of the score for each frequency region and for each sample calculated in the score calculating section; and a BPM determining section which determines the BPM corresponding to a frequency in the frequency region, in which it is assumed that the correct BPM is present, corresponding to the samples having a maximum score addition value among score addition values for each of the samples obtained by the addition of the score adding section, as the BPM indicating the tempo.

2. The tempo detection device according to claim 1, wherein the basic feature amount extracting section divides the input audio signal into frames including a predetermined number of pieces of sample data and extracts the basic feature amounts of the plurality of types for each frame.

3. The tempo detection device according to claim 2, wherein the basic feature amount extracting section includes:

a short-time Fourier transform section which performs a short-time Fourier transform for each frame of the input audio signal; and a basic feature amount calculating section which calculates the basic feature amounts of the plurality of types on the basis of a frequency spectrum for each frame output from the short-time Fourier transform section.

4. A tempo detection device comprising:

a basic feature amount extracting section which extracts a plurality of types of basic feature amounts from an input audio signal;

a weighting and adding section which weights and adds the basic feature amounts of the plurality of types extracted in the basic feature amount extracting section to obtain an addition signal; and a tempo detecting section which detects BPM indicating the tempo on the basis of a periodic component included in the addition signal obtained in the weighting and adding section, wherein the tempo modifying section obtains a first sense of speed for determining whether the correct BPM is present on a high pass side with reference to the frequency region in which it is assumed that the correct BPM is present and obtains a second sense of speed for determining whether the correct BPM is present on a low pass side with reference to the frequency region in which it is assumed that the correct BPM is present, on the basis of the basic feature amounts of the plurality of types; doubles the BPM detected in the tempo detecting section, when it is determined that the correct BPM is present on the high pass side with reference to the frequency region in which it is assumed that the correct BPM is present through the first sense of speed, to output the BPM; reduces the BPM detected in the tempo detecting section into one half, when it is determined that the correct BPM is present on the low pass side with reference to the frequency region in which it is assumed that the correct BPM is present through the second sense of speed, to output the BPM; and outputs the BPM detected in the tempo detecting section as the BPM as it is when it is determined that the correct BPM is not present on the high pass side with reference to the frequency region in which it is assumed that the correct BPM is present through the first sense of speed, and when it is determined that the correct BPM is not present on the low pass side with reference to the frequency region in which it is assumed that the correct BPM is present through the second sense of speed.

5. The tempo detection device according to claim 4, wherein the basic feature amount extracting section divides the input audio signal into the frames including the predetermined number of pieces of sample data and extracts the basic feature amounts of the plurality of types for each frame, and wherein the tempo modifying section obtains the first sense of speed and the second sense of speed for each block including a predetermined number of frames; obtains the first sense of speed by weighting averages and standard deviations of the basic feature amounts of the plurality of types in the predetermined number of frames by a first coefficient group obtained by learning in advance and by adding the weighted averages and standard deviations; and obtains the second sense of speed by weighting the averages and the standard deviations of the basic feature amounts of the plurality of types in the predetermined number of frames by a second coefficient group obtained by learning in advance and by adding the weighted averages and standard deviations.

6. A tempo detection method comprising:

extracting a plurality of types of basic feature amounts from an input audio signal;

weighting and adding the basic feature amounts of the plurality of types extracted in the basic feature amount extracting to obtain an addition signal; and detecting BPM using a tempo detecting section, wherein the tempo detecting section includes:

a fast Fourier transform section which performs a fast Fourier transform for the addition signal for each frame obtained in the weighting and adding section;

a score calculating section which divides respective samples in a frequency axis output from the fast Fourier transform section into a predetermined number of continuous frequency regions, which include a frequency region in which it is assumed that a correct BPM is present, and in which a frequency region adjacent to a low pass side becomes one half and a frequency region adjacent to a high pass side becomes double, and calculates a score corresponding to the level of each sample data for each frequency region and for each sample;

a score adding section which matches the numbers of samples of the respective frequency regions and adds the sample scores of the respective frequency regions for the corresponding samples, on the basis of the score for each frequency region and for each sample calculated in the score calculating section; and a BPM determining section which determines the BPM corresponding to a frequency in the frequency region, in which it is assumed that the correct BPM is present, corresponding to the samples having a maximum score addition value among score addition values for each of the samples obtained by the addition of the score adding section, as the BPM indicating the tempo.

7. A non-transitory, computer-readable medium comprising instructions that cause a computer to perform a method comprising:

extracting a plurality of types of basic feature amounts from an input audio signal;

weighting and adding the basic feature amounts of the plurality of types extracted in the basic feature amount extracting section to obtain an addition signal; and detecting BPM using a tempo modifying section, wherein the tempo modifying section indicates the tempo on the basis of a periodic component included in the addition signal obtained in the weighting and adding section, and wherein the tempo modifying section obtains a first sense of speed for determining whether the correct BPM is present on a high pass side with reference to the frequency region in which it is assumed that the correct BPM is present and obtains a second sense of speed for determining whether the correct BPM is present on a low pass side with reference to the frequency region in which it is assumed that the correct BPM is present, on the basis of the basic feature amounts of the plurality of types; doubles the BPM detected in the tempo detecting section, when it is determined that the correct BPM is present on the high pass side with reference to the frequency region in which it is assumed that the correct BPM is present through the first sense of speed, to output the BPM; reduces the BPM detected in the tempo detecting section into one half, when it is determined that the correct BPM is present on the low pass side with reference to the frequency region in which it is assumed that the correct BPM is present through the second sense of speed, to output the BPM; and outputs the BPM detected in the tempo detecting section as the BPM as it is when it is determined that the correct BPM is not present on the high pass side with reference to the frequency region in which it is assumed that the correct BPM is present through the first sense of speed, and when it is determined that the correct BPM is not present on the low pass side with reference to the frequency region in which it is assumed that the correct BPM is present through the second sense of speed.

* * * * *